US009097084B2

(12) United States Patent
McDougall et al.

(10) Patent No.: US 9,097,084 B2
(45) Date of Patent: Aug. 4, 2015

(54) COILED TUBING PUMP DOWN SYSTEM

(71) Applicant: Schlumberger Technology Corporation, Sugar Land, TX (US)

(72) Inventors: Thomas Daniel McDougall, Sugar Land, TX (US); Teoman Altinkopru, Sugar Land, TX (US); Patrick Schorn, Houston, TX (US); Mustafa Mert Erbil, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 362 days.

(21) Appl. No.: 13/661,684

(22) Filed: Oct. 26, 2012

(65) Prior Publication Data

US 2014/0116724 A1 May 1, 2014

(51) Int. Cl.

| | |
|---|---|
| ***E21B 19/22*** | (2006.01) |
| ***E21B 23/08*** | (2006.01) |
| ***E21B 34/14*** | (2006.01) |

(52) U.S. Cl.

CPC ..... *E21B 23/08* (2013.01); *E21B 34/14* (2013.01)

(58) Field of Classification Search

CPC ..... E21B 23/08; E21B 4/18; E21B 21/10; E21B 23/04; E21B 23/008; E21B 34/14

USPC ..... 166/373, 386, 381, 385, 77.2, 77.1

See application file for complete search history.

(56) References Cited

U.S. PATENT DOCUMENTS

| | | | | |
|---|---|---|---|---|
| 4,161,985 | A | 7/1979 | Fournier et al. | |
| 4,276,937 | A | 7/1981 | Calhoun et al. | |
| 4,458,762 | A | 7/1984 | McMahan | |
| 4,729,432 | A | 3/1988 | Helms | |
| 4,846,281 | A | 7/1989 | Clary et al. | |
| 5,253,712 | A | 10/1993 | Swor | |
| 5,285,850 | A | 2/1994 | Bayh | |
| 5,411,096 | A | 5/1995 | Akkerman | |
| 5,494,103 | A * | 2/1996 | Surjaatmadja et al. | 166/222 |
| 5,695,009 | A * | 12/1997 | Hipp | 166/196 |
| 6,209,663 | B1 | 4/2001 | Hosie | |
| 6,311,775 | B1 | 11/2001 | Allamon et al. | |

(Continued)

FOREIGN PATENT DOCUMENTS

| | | |
|---|---|---|
| EA | 005916 B1 | 6/2005 |
| RU | 2245476 C1 | 1/2005 |

(Continued)

OTHER PUBLICATIONS

International Search Report and the Written Opinion for International Application No. PCT/US2013/066489 dated Feb. 20, 2014.

*Primary Examiner* — Daniel P Stephenson

(74) *Attorney, Agent, or Firm* — Michael L. Flynn; Timothy Curington; Robin Nava

(57) ABSTRACT

A system and methodology facilitates an operation utilizing coiled tubing. The technique comprises coupling a hydraulic assist device to coiled tubing. A fluid is flowed into an enclosure such as a wellbore and along the coiled tubing. The fluid is flowed against the hydraulic assist device, and the action of this fluid against the hydraulic assist device creates a pulling force on the coiled tubing. The pulling force facilitates movement of the coiled tubing along the wellbore or other enclosure to provide the coiled tubing with greater reach for a variety of intervention operations or other types of operations.

20 Claims, 4 Drawing Sheets

(56) References Cited

U.S. PATENT DOCUMENTS

| | | | | |
|---|---|---|---|---|
| 6,315,498 | B1 | 11/2001 | Baugh et al. | |
| 6,446,727 | B1 | 9/2002 | Zemlak et al. | |
| 7,025,142 | B2 * | 4/2006 | Crawford | 166/311 |
| 7,234,521 | B2 * | 6/2007 | Shammai et al. | 166/264 |
| 7,380,596 | B2 | 6/2008 | De Clute-Melancon | |
| 7,406,738 | B2 * | 8/2008 | Kinnari et al. | 15/3.5 |
| 7,431,094 | B2 | 10/2008 | De Clute-Melancon | |
| 7,584,800 | B2 | 9/2009 | Heath et al. | |
| 7,594,542 | B2 | 9/2009 | Loretz et al. | |
| 7,614,452 | B2 | 11/2009 | Kenison et al. | |
| 7,841,412 | B2 | 11/2010 | Jasser et al. | |
| 7,849,924 | B2 | 12/2010 | Surjaatmadja et al. | |
| 7,874,366 | B2 | 1/2011 | Allcorn et al. | |
| 7,926,572 | B2 | 4/2011 | Erkol et al. | |
| 7,926,580 | B1 | 4/2011 | Darnell et al. | |
| 7,980,306 | B2 | 7/2011 | Lovell et al. | |
| 8,479,821 | B2 * | 7/2013 | Crawford et al. | 166/311 |
| 2014/0116724 | A1 * | 5/2014 | McDougall et al. | 166/380 |

FOREIGN PATENT DOCUMENTS

| | | | |
|---|---|---|---|
| RU | 2349751 | C2 | 3/2009 |
| RU | 2402712 | C2 | 10/2010 |
| WO | 2008081402 | A1 | 7/2008 |

* cited by examiner

COILED TUBING PUMP DOWN SYSTEM

BACKGROUND

Coiled tubing has been used in a variety of well intervention applications. However, there are practical limits to the depth that a length of coiled tubing can be pushed along a given wellbore. The limitations with respect to reach of the coiled tubing may be due to a number of factors, such as friction between the coiled tubing and a wellbore wall. Certain limitations also may result from the propensity of the coiled tubing to helically buckle under loading as the coiled tubing is pushed through the wellbore.

SUMMARY

In general, the present disclosure provides a system and method for facilitating a downhole operation utilizing coiled tubing. The technique comprises coupling a hydraulic assist device to coiled tubing. A fluid is flowed downhole into a wellbore and along the coiled tubing. The fluid is flowed against the hydraulic assist device, and the action of this fluid against the hydraulic assist device creates a pulling force on the coiled tubing. The pulling force facilitates movement of the coiled tubing along the wellbore to provide the coiled tubing with greater reach for a variety of intervention operations or other downhole operations. The technique also may be used in non-well applications having elongate enclosures other than a wellbore.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
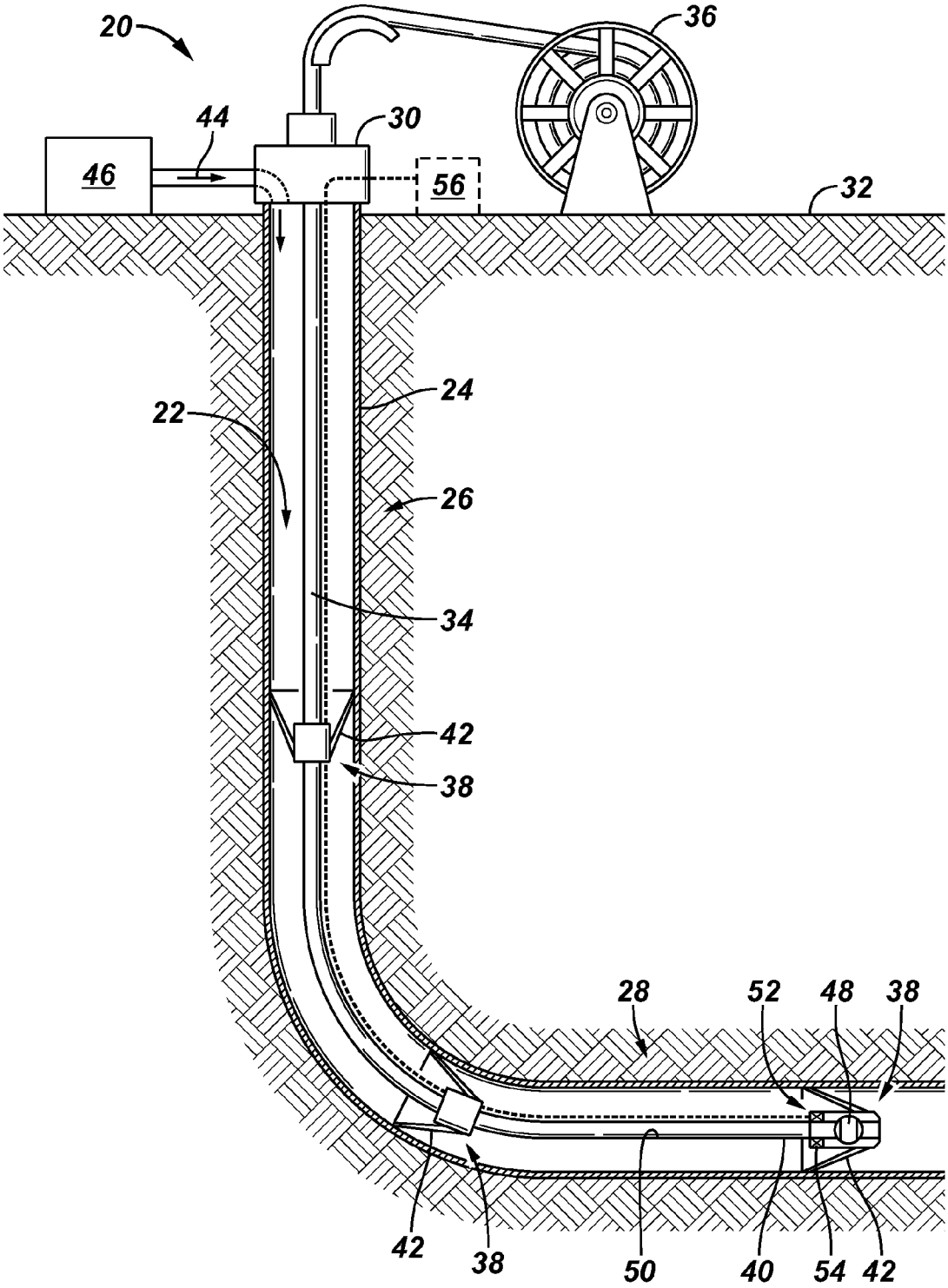
FIG. 1 is a schematic illustration of a well system comprising at least one hydraulic assist device coupled to coiled tubing and disposed within a wellbore, according to an embodiment of the disclosure.

In the follow description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally involves a system and methodology that relate to extending the reach of coiled tubing in well applications or other applications by applying a pulling force to the coiled tubing. Embodiments of the methodology comprise coupling a hydraulic assist device to coiled tubing and flowing a fluid downhole into a wellbore. The fluid is flowed along an exterior of the coiled tubing and against the hydraulic assist device. The action of this fluid against the hydraulic assist device creates a pulling force on the coiled tubing which helps move the coiled tubing along the wellbore. This pulling force provides the coiled tubing with greater reach for a variety of intervention operations or other downhole operations. In embodiments described herein, the use of the hydraulic assist device is described with reference to a variety of downhole, well related operations. However, the technique also may be used to facilitate movement of tubing through other types of surrounding enclosures, e.g. tubes.

In some examples, the technique involves using the hydraulic assist device to provide an additional hydraulic load at a lead end of the coiled tubing. In at least some of these applications, the driving fluid pumped down along an exterior of the coiled tubing to drive the coiled tubing through the surrounding enclosure, e.g. wellbore, by creating a pulling force. By way of example, the hydraulic assist device may comprise a flexible sealing ring or a plurality of flexible sealing rings that capture/block hydraulic fluid pumped down along an annulus formed between the coiled tubing and the casing. The pumped fluid acting against the flexible sealing rings provides the additional load on the coiled tubing in a direction that moves the coiled tubing farther along the wellbore. However, a variety of other types of hydraulic assist devices may be employed depending on the parameters of a given application. In at least some examples, the coiled tubing also may be integrated with a valve, such as a smart check valve or check valves, that can be activated on demand to selectively enable or block flow of fluid along an interior of the coiled tubing.

Depending on the application, an individual hydraulic assist device or a plurality of hydraulic assist devices may be coupled to the coiled tubing. The hydraulic assist device or devices may be connected to a lead end and/or along a length of the coiled tubing at predetermined positions. The hydraulic assist device(s) facilitates movement of the coiled tubing along a variety of wellbores of other enclosures, such as along horizontal wellbores to enhance the reach of the coiled tubing in intervention operations and other types of operations. If a valve is utilized within the coiled tubing, the operation may be designed to enable selective circulation of fluid through the valve and along an interior of the coiled tubing. In some embodiments, the valve may be designed to remain in an inactive, e.g. open, position production of fluids up through the interior of the coiled tubing until the valve is selectively activated to a closed configuration. For example, the valve can be closed at specific operational positions along a horizontal wellbore section to accommodate a predetermined intervention operation.

The hydraulic assist device may be designed to enable selective radial expansion so that fluid delivered down through the wellbore along the exterior of the coiled tubing applies a pressure against the hydraulic assist device. The pressure created against the hydraulic assist device by the fluid delivered, e.g. pumped, down through the wellbore creates a differential pressure mat results in a pulling force applied to the coiled tubing. The selective radial expansion of the hydraulic assist device may be powered by the flowing fluid or by other types of actuation mechanisms which radially expand the hydraulic assist device to effectively create a blockage which generates the desired differential pressure. In at least some applications, the hydraulic assist device may be selectively, radially contracted by reducing the fluid flow and/or by actuating the hydraulic assist device to a contracted position. When in the radially contracted configuration, the coiled tubing is readily removed from the wellbore and is less susceptible to interference with certain completion components and other potential well system components which may restrict the diameter of the flow path along the wellbore.

A predetermined pulling three may be created to help move tubing through a surrounding enclosure in well related applications and other types of applications. Depending, on the specifics of such an application, the number and position of the hydraulic assist devices along the tubing e.g. coiled tubing, may be adjusted. Additionally, the types of fluid or fluids pumped down along the exterior of the tubing may vary depending on the parameters of the specific operation. The fluid pumping sequences, fluid flow rates, fluid viscosities, and other parameters of the fluid and/or hydraulic assist device may be adjusted to accommodate the characteristics of a given application.

Referring generally to FIG. 1, an embodiment of a system e.g. well system, for increasing the reach of coiled tubing in a well is illustrated. By way of example, the well system may comprise many types of components and may be employed in many types of applications and environments, including cased wells and open-hole wells. The well system also may be utilized in vertical wells and deviated wells, e.g. horizontal wells. The system may utilize individual or plural hydraulic assist devices to help move tubing through many types of enclosures in a variety of applications.

In the example of FIG. 1, a system 20 is illustrated in the form of a well system deployed in a wellbore 22. In well applications, system 20 is designed to facilitate a downhole operation, such as an intervention operation. The wellbore 22 may be lined with a well casing 24, although some operations may be carried out in open wellbores or wellbores with open hole segments. As illustrated, wellbore 22 comprises a generally vertical section 26 which extends down to a deviated section 28, such as a generally horizontal section of the wellbore 22. The vertical section 26 extends down from surface equipment 30, e.g. wellhead, positioned at a surface location 32.

Coiled tubing 34 is deployed down into wellbore 22 from a coiled tubing reel 36 positioned at a suitable surface location. The coiled tubing 34 may be deployed down through the vertical section 26 and into the deviated section 28 to facilitate performance of a well operation, e.g. intervention operation/treatment operation, at a desired location or locations along the wellbore 22. At least one hydraulic assist device 38 is coupled with the coiled tubing 34 to facilitate movement of the coiled tubing 34 along the wellbore 22 and to thus extend the reach of the coiled tubing for performing the downhole operation or operations. In the example illustrated, a lead hydraulic assist device 38 is positioned at a lead end 40 of the coiled tubing, and additional hydraulic assist devices 38 are mounted at spaced intervals along a portion of the coiled tubing 34. Depending on the operation, an individual hydraulic assist device 38 or plural hydraulic assist devices 38 may be connected to the coiled tubing 34.

Referring again to FIG. 1, each hydraulic assist device 38 may be transitioned between radially contracted and radially expanded configurations. For example, each hydraulic assist device 38 may comprise an expansion component 42 which may be selectively transitioned between radially contracted and radially expanded positions. Depending on the parameters of a given application, the expansion component 42 may be formed of a variety of materials and in a variety of configurations. For example, the expansion component 42 may comprise individual or plural wipers, sealing rings, inflatable elements, and other suitable types of expansion components or combinations of components. Additionally, the expansion component 42 may comprise a variety of materials, including elastomeric materials, metal materials, composite materials, sealing materials, and/or other suitable materials.

As illustrated, each hydraulic assist device 38 has been transitioned to the radially expanded position to interfere with a fluid, represented by arrows 44, which is delivered downhole within wellbore 22 along an exterior of coiled tubing 34. In some applications, the fluid 44 is pumped down along the annulus between coiled tubing 34 and casing 24 by a pumping system 46. The pumped fluid 44 acts against the uphole side of the expansion component 42 (of each hydraulic assist device 38) and establishes a pressure differential between the uphole and downhole sides of the hydraulic assist device. This differential pressure creates a pulling force on the coiled tubing 34 which helps move the coiled tubing 34 along wellbore 22, thus extending the reach of the coiled tubing 34 within the wellbore 22.

In some embodiments, a valve 48 is positioned to selectively control flow of fluid along an interior 50 of coiled tubing 34. For example, valve 48 may be positioned within the coiled tubing 34 to selectively enable or block flow along interior 50 during running of coiled tubing 34 downhole. The valve 48 also may be selectively opened to enable circulation of fluid downhole and back up to the surface. By way of example, at least one of the hydraulic assist devices 38 may be designed to include valve 48, and some applications provide each of the hydraulic assist devices 38 with at least one valve 48 to enable selective control of fluid through each hydraulic assist device 38 along interior 50.

The overall system 20 also may comprise a variety of cooperating components. For example, a sensor system 52 having a sensor of sensors 54 may be located on at least one of the hydraulic assist devices 38 and/or at other suitable locations along wellbore 22 and coiled tubing 34. The sensor(s) 54 and sensor system 52 may be employed to detect and monitor pressures, temperatures, position, and/or other parameters related to the downhole operation. Additionally, a telemetry system 56 may be used to relay data from and/or to sensor system 52. The telemetry system 56 also may be employed for carrying a variety of other types of signals along wellbore 22 between desired components.

Figure 2:
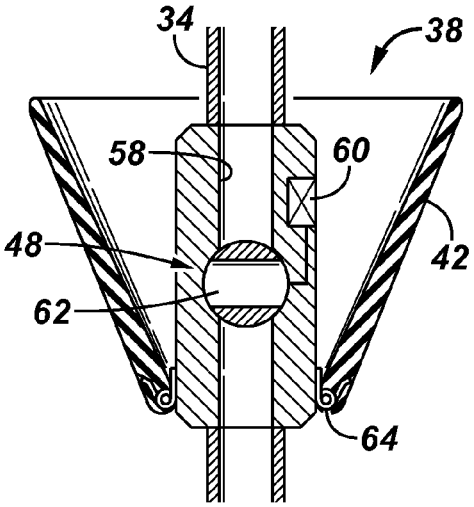
FIG. 2 is a schematic illustration of an example of a hydraulic assist device, according to an embodiment of the disclosure.
Figure 3:
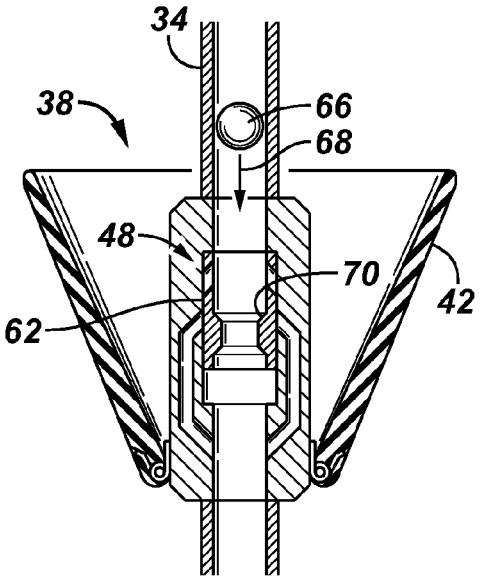
FIG. 3 is a schematic illustration of another example of a hydraulic assist device, according to an embodiment of the disclosure.

Referring generally to FIGS. 2 and 3, embodiments of hydraulic assist device 38 are illustrated schematically. In FIG. 2, the hydraulic assist device 38 includes valve 48 positioned along an internal passageway 58 winch extends generally longitudinally through the hydraulic assist device 38 and forms part of the overall hollow interior 50 of coiled tubing 34. Valve 48 may be constructed in a variety of configurations and may comprise check valves, flapper valves, ball valves, sleeve valves, and other types of suitable valves. Additionally, the valve 48 may be transitioned between an open/active configuration and a closed configuration by an actuator 60, such as electrical actuator or hydraulic actuator. The electrical or hydraulic actuator 60 operates a valve member 62 which is selectively opened or closed to permit or block flow, respectively, along interior 50. In some hydraulic applications, the hydraulic actuator may be at an uphole surface location and supply hydraulic actuating fluid downhole via a control line to transition valve member 62. Additionally, the actuator 60 (or an additional actuator 60) may be used to transition expansion component 42 between the radially contracted and radially expanded configurations, although some applications utilize the power of flowing fluid 44 to automatically transition each hydraulic assist device 38 to a radially expanded configuration. Also, a spring member or spring members 64 may be employed in some embodiments to bias the expansion component 42 to a specific position, such as a radially contracted position of a radially expanded position. Transitioning the hydraulic assist device 38 to a radially contracted configuration facilitates removal of the coiled tubing 34 from wellbore 22 by, for example, enabling easier passage through a variety of components, e.g. radially constricted completion components.

FIG. 3, another example of hydraulic assist device 38 is illustrated as incorporating valve 48 to selectively block or allow flow along the interior 50 of coiled tubing 34. In this example, valve 48 is a ball actuated valve designed for engagement with a ball 66 dropped down through interior 50, as indicated by arrow 68. The ball 66 is dropped into engagement with a ball receiver 70, and pressure applied along the interior 50 causes ball 66 to transition valve 48. For example, valve 48 may be designed so that ball 66 removes valve member 62 or transitions valve member 62 to a different configuration, e.g. transitions valve member 62 from a closed position to an open flow position.

Figure 4:
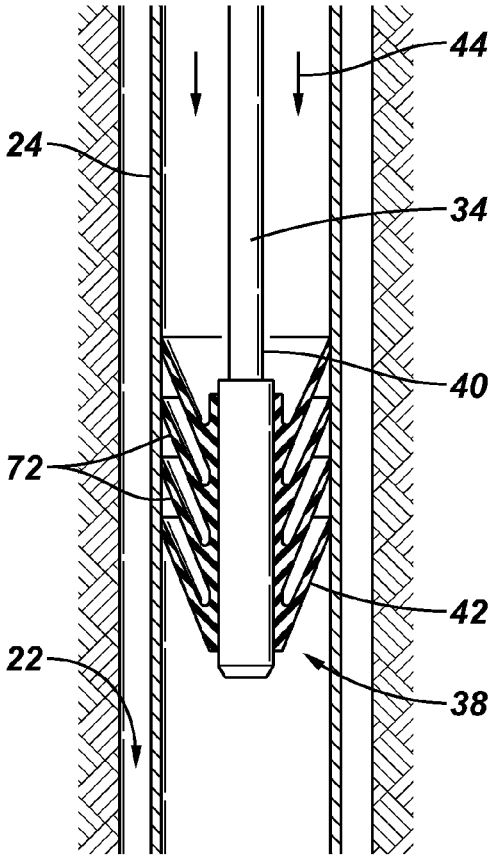
FIG. 4 is a schematic illustration of an example of a cup type hydraulic assist device coupled to coded tubing and deployed in a wellbore, according to an embodiment of the disclosure.

Referring generally to FIG. 4, another embodiment of hydraulic assist device 38 is illustrated. In this embodiment, the hydraulic assist device 38 comprises expansion component 42 in the form of at least one flexible sealing ring 72. By way of example, the expansion component 42 may comprise a plurality of sequential, flexible sealing rings 72. The flexible sealing rings 72 are oriented to catch flowing fluid 44 and to expand in a radially outward direction to further block flow of fluid 44, thus creating a pressure differential across the hydraulic assist device 38. This pressure differential creates a pulling force on coiled tubing 34 which moves the coiled tubing 34 along wellbore 22. In some applications, the flexible sealing rings 72 expand radially outward into engagement with a surrounding wellbore wall, e.g. an internal wall of casing 24, to provide additional pulling load on coiled tubing 34. In the illustrated example, the flexible sealing rings 72 are positioned generally at lead end 40 of the coiled tubing. Flexible sealing rings 72 may be formed out of elastomeric materials, such as rubbers or other flexible materials. However, the sealing rings 72 also may be formed in whole or in part out of flexible metal materials, composites materials, or other suitable materials.

Figure 5:
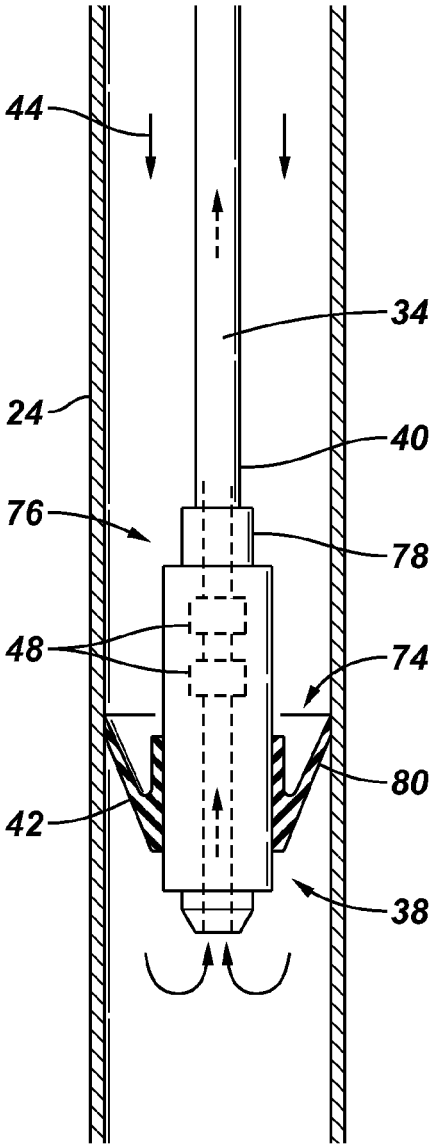
FIG. 5 is a schematic illustration of a radially expandable hydraulic assist device coupled to coiled tubing and deployed in a wellbore, according to an embodiment of the disclosure.

Referring generally to FIG. 5, another example of hydraulic assist device 38 is illustrated. In this embodiment the hydraulic assist device 38 comprises expansion component 42 in the form of a conically shaped device 74 mounted, for example, at lead end 40 of coiled tubing 34. The conically shaped device 74 may be part of a bottom hole assembly 76 and may be coupled to coiled tubing 34 via a coiled tubing connector 78. The coiled tubing connector 78 may utilize clamps, fasteners, or other devices for coupling the hydraulic assist device 38 to coiled tubing 34. The conically shaped device 74 functions to convert hydraulic force created by fluid 44 as it is pumped down from the surface into wellbore 22 and along an exterior of coiled tubing 34. Fluid 44 flows along the annulus between coiled tubing 34 and the surrounding wellbore wall, e.g. casing 24. As with other embodiments described herein, the pumped fluid 44 acts against hydraulic assist device 38 (e.g. against conically shaped device 74) to create a pulling force which increases the reach of the coiled tubing 34 in, for example, a horizontal well. The pulling force also reduces the potential for buckling of the coiled tubing 34.

Figure 6:
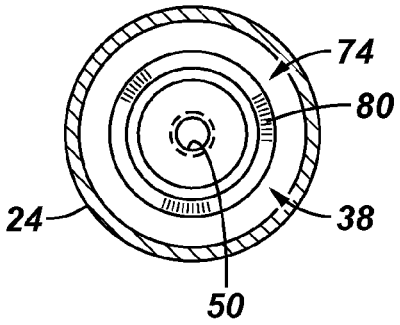
FIG. 6 is a schematic illustration of the radially expandable hydraulic assist device in a radially contracted position, according to an embodiment of the disclosure.
Figure 7:
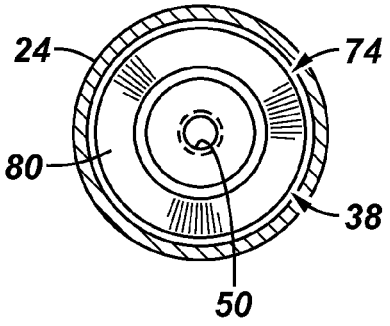
FIG. 7 is a schematic illustration of the radially expandable hydraulic assist device in a radially expanded position, according to an embodiment of the disclosure.

The conically shaped device 74 may be constructed as an individual or plural wipers 80 designed with residual collapsing capabilities. Each wiper 80 may be designed to open up to the extent of the wellbore internal diameter under the influence of increasing flow rate of fluid 44. The expanding wiper or wipers 80 causes the differential pressure across the hydraulic assist device 38 and thus creates the pulling three for moving coiled tubing 34 along wellbore 22. The ability of wipers 80 to collapse in a radially inward direction when there is no differential pressure across the hydraulic assist device 38 (or when the differential pressure is below a threshold value) facilitates passage of the bottom hole assembly 76 through restrictions and profiles when pulling out of hole. In FIG. 6, wiper 80 is illustrated in a radially contracted or collapsed position which allows easy withdrawal of the coiled tithing 34. However, when fluid 44 is pumped down along the exterior of coiled tubing 34, each wiper 80 is automatically expanded to the radially outward configuration illustrated in FIG. 7.

Conversion of the hydraulic force of fluid 44 to a linear pull force may be a function of the surface area of the wiper 80 (or other expansion component 42) and of the differential pressure applied. The pulling force may be adjusted according to the parameters of a given application to pull the coiled tubing string along wellbore 22 and to extend the reach of the coiled tubing string to greater distances along, for example, deviated section 28 of wellbore 22.

In some applications, a valve or valves 48 may be combined with hydraulic assist device 38, as illustrated. By way of example, valves 48 may comprise smart check valves which may be selectively positioned to provide dual capabilities for running in hole in an active or passive mode. If, for example, coiled tubing 34 is run downhole with the valve 48 in an active mode to block fluid flow along interior 50, the valve 48 may be subsequently transitional to a passive mode winch allows fluid flow along interior 50. By way of example, the valve 48 may be designed for actuation from an active mode to a passive mode by dropping ball 66 from the surface of by operating actuator 60 depending on the specific design of the valve 48. Once the valve 48 is transitioned to the passive mode, fluids can be produced from the well up through the interior 50 of coiled tubing 34. In some applications, a subsequent ball 66 or subsequent actuation of actuator 60 can be used to shift the valve 48 back to an active mode blocking flow along interior 50. In other applications, each valve 48 can be run downhole with coiled tubing 34 in a passive mode which allows flow along interior 50 and then transitioned to an active mode via, for example, ball 66 or actuator 60.

Figure 8:
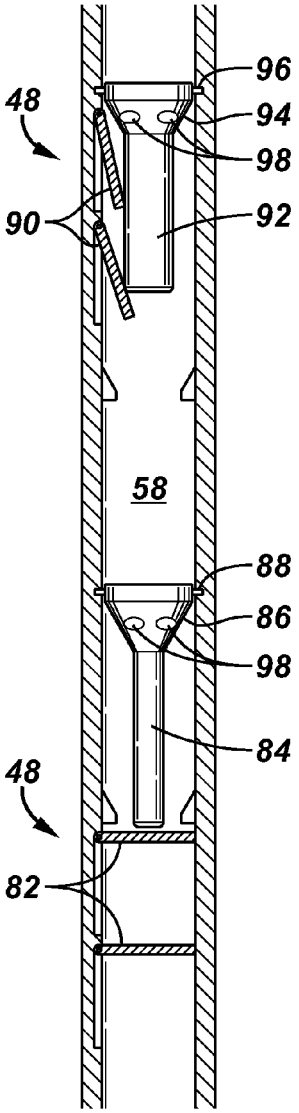
FIG. 8 is a schematic illustration of a coiled tubing system with a hydraulic assist device having at least one internal valve, according to an embodiment of the disclosure.

Depending on the application, various combinations of valves 48 and valve types may be employed to facilitate a given operation. Referring generally to the embodiment of FIGS. 8-10, for example, a plurality of valves 48 may be employed, and the valves 48 may be in the form of check valves positioned in active mode and/or passive mode during movement of coiled tubing 34 downhole. As illustrated in FIG. 8, for example, valves 48 are placed in initial predetermined configurations and positioned sequentially in the hydraulic assist device 38.

A first valve 48 comprises a first set of check valves 82 which cooperate with a combined first sleeve 84 and first ball profile 86 held in place by a shear member 88, e.g. shear pins, within passageway 58 of the hydraulic assist device 38. Similarly, a second valve 48 comprises a second set of check valves 90 which cooperate with a combined second sleeve 92 and second ball profile 94 held in place by a shear member 96, e.g. shear pins. By way of example, the first and second ball landing profiles 86, 94 may be perforated with holes 98 which are exposed upon shifting. Additionally, when balls 66 land on profiles 86, 94, they may be secured with a captive mechanism while the corresponding sleeves 84, 92 are shifted, thus preventing flow back. In FIG. 8, the first check valves 82 are positioned in an active or closed mode and the second check valves 90 are positioned in a passive or open mode.

Figure 9:
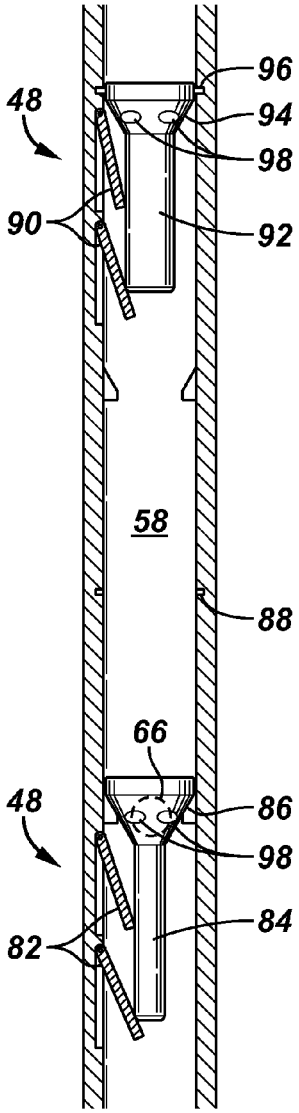
FIG. 9 is a schematic illustration similar to that of FIG. 8 but showing the valve in a different operational configuration, according to an embodiment of the disclosure.

During an activation procedure, a first ball 66 may be dropped from the surface and assisted along interior 50 by pumping fluid down along interior 50. In this example, the second sleeve 92 and second ball landing profile 94 have a larger diameter than the first sleeve 84 and first hall landing profile 86. Thus, the first ball 66 passes through the second sleeve 92 and lands in first ball landing profile 86, as illustrated in FIG. 9. By applying suitable pressure down through the interior 50 of coiled tubing 34, the shear member 88 may be sheared to allow first sleeve 84 to move down through first check valves 82, thus forcing them to an open or active position, as illustrated in FIG. 9. In some applications, the first check valves 82 may be locked in this open mode. It should also be noted that during shifting of the first sleeve 84, the openings 98 may be exposed on the first ball landing profile 86.

Figure 10:
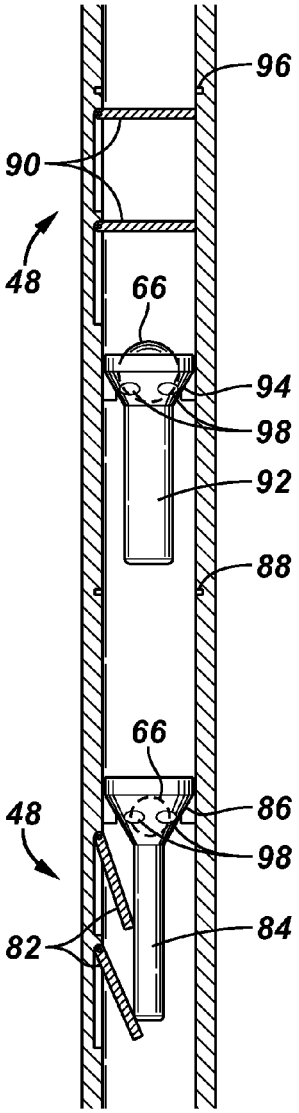
FIG. 10 is a schematic illustration similar to that of FIG. 8 but showing the valve in a different operational configuration, according to an embodiment of the disclosure.

Subsequently, a larger diameter ball 66 may be dropped down along interior 50 of coiled tubing 34 and pumped into engagement with the second ball landing profile 94. By applying suitable pressure down through the interior 50 of coiled tubing 34, the shear member 96 may be sheared to allow second sleeve 92 and second ball landing profile 94 to move past second check valves 90, as illustrated in FIG. 10. This allows the second check valves 90 to transition to an active or closed configuration, as illustrated. In some applications, the valves, e.g. second check valves 90, may be spring biased to the closed configuration and locked in this active mode. The openings 98 on the second ball landing profile 94 may be exposed or open when transitioned.

The embodiments described with reference to FIGS. 8-10 are provided as examples of valves that can be used to provide sequential closing, opening and closing of the interior flow passage 50. However, a variety of other valve arrangements and operational sequences may be employed depending on the desired sequence of "flow" and/or "no flow" configurations with respect to flow of fluid along the interior 50 of coiled tubing 34. Additionally, other types of valves may be used instead of the illustrated check valves to provide the desired functionality, and some of those other types of valves have been described previously herein.

Similarly various types of expansion components 42 may be combined with valve 48 to provide hydraulic assist devices 38 with the ability to convert hydraulic force of fluid 44 to a pull force for moving coiled tubing 34 over farther distances in deviated, e.g. horizontal, or vertical wellbores. For example, the expansion components 42 may be made from composite materials, metal materials, plastic/rubber materials, and/or other materials constructed in a variety of shapes and designs according to the parameters of a given application. Additionally, valves 48 may be integrated into or attached to other components of the hydraulic assist device 38 and/or coiled tubing 34 and may comprise various valve types. For example, valves 48 may comprise ball type valves, J-slot valves, positive differential valves, electrically activated valves hydraulically activated valves, fiber-optic activated valves, stored energy activated valves, spring type valves, dart type valves, or other suitable valve types.

Additionally, the coiled tubing 34 may be constructed in a variety of sizes and from a variety of materials depending on the environment and the parameters of a given application. Various coiled tubing connectors and bottom hole assembly components may be integrated into the overall system. Additionally, the telemetry system 56 may be a real-time telemetry system used inside or outside of the coiled tubing 34. The telemetry system 56 also may utilize various signal carrying techniques, including signals carried via e-line cable, fiber optics, pulse telemetry, and other suitable techniques.

The extended reach technique of applying a pulling force to the coiled tubing also may be used in a variety of environments and well or non-well applications. For example, the technique may be used in gas wells, oil wells, wells with condensate, water injection wells, H2S steam applications, offshore wells, onshore wells, deep water wells, horizontal wells, vertical wells, multilateral wells, or other types of wells or well applications. Similarly, the technique may be used in non-well applications in which a smaller tubing is delivered over substantial distances within a larger surrounding enclosure. The technique also may be used on offshore platforms, land fields, deepwater floaters, drillships, intervention vessels, and other suitable types of installations.

Application of the pulling force to coiled tubing also may be used with a variety of completions, including open hole or cased hole completions. Such completions may be formed in several configurations and sizes incorporating various screens, tubulars and/or materials adapted for use in environments of wide-ranging temperatures and pressures. The technique also is suitable for use with many types of surface controls and with a variety of fluids pumped down into the wellbore and/or produced from the wellbore. The pulling force may be employed to facilitate many types of intervention activities including wellbore cleanout, matrix acidizing, logging, underbalanced or balanced drilling, nitrogen kick off, fishing, milling, or other intervention activities.

Depending on the application and/or environment in which the well system 20 is employed, the overall system may be designed accordingly. For example, the optimum size and expansion ratio of the expansion components 42 may be determined for a given application. Additionally, the size, type and number of the hydraulic assist devices 38 along coiled tubing 34 may be determined according to the parameters of a given application and environment. In some applications, for example, a main hydraulic assist device 38 may be positioned at the lead end 40 of coiled tubing 34. Additionally, the pump rates, fluid type, fluid viscosity, and the sequence of fluids and pump rates, if desired, may be adjusted according to the specific application. The specific methodology of running the coiled tubing string in hole and pulling out of hole also may be determined according to the same parameters and considerations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for facilitating a downhole operation, comprising:

a coiled tubing deployed in a wellbore;

a hydraulic assist device coupled to the coiled tubing proximate a lead end of the coiled tubing, the hydraulic assist device selectively transitionable between a radially contracted position and a radially expanded position and biased by a biasing member in the radially contracted position;

a valve positioned in the coiled tubing, the valve being selectively transitionable between an open flow position allowing fluid flow along the interior of the coiled tubing and a closed flow position; and a pumping system operable to pump fluid down the wellbore along an exterior of the coiled tubing to apply a pressure against the hydraulic assist device, when the hydraulic assist device has been transitioned to the radially expanded position, thus creating a pulling force on the coiled tubing to pull the coiled tubing along the wellbore.

2. The system as recited in claim 1, wherein the hydraulic assist device comprises a wiper which is expanded radially outward by the fluid pumped down along the wellbore.

3. The system as recited in claim 1, wherein the hydraulic assist device comprises a flexible sealing ring which is expanded radially outward by the fluid pumped down along the wellbore.

4. The system as recited in claim 1, wherein the hydraulic assist device comprises a selectively expandable member.

5. The system as recited in claim 1, wherein the valve is a ball actuated valve.

6. The system as recited in claim 1, wherein the valve comprises a plurality of check valves.

7. The system as recited in claim 1, wherein the valve comprises an electrically actuated valve.

8. The system as recited in claim 1, wherein the valve comprises a hydraulically actuated valve.

9. The system as recited in claim 1, wherein the hydraulic assist device comprises a plurality of hydraulic assist devices mounted sequentially along the coiled tubing.

10. The system as recited in claim 1, further comprising a telemetry system coupled with a downhole sensor system.

11. A method of performing a downhole operation, comprising:

coupling a hydraulic assist device to coiled tubing;

positioning a valve within the coiled tubing and adjacent the hydraulic assist device;

delivering a fluid downhole along the coiled tubing to the hydraulic assist device;

causing the hydraulic assist device to expand radially outward so that a differential pressure builds across the hydraulic assist device due to the fluid delivered downhole;

using the fluid acting against the hydraulic assist device to pull the coiled tubing along the wellbore;

performing the downhole operation; and causing the hydraulic assist device to contract radially inward, thereby assisting the removal of the coiled tubing.

12. The method as recited in claim 11, wherein using comprises using the fluid to pull the coiled tubing along a generally horizontal wellbore.

13. The method as recited in claim 11, wherein positioning comprises positioning a check valve within the coiled tubing.

14. The method as recited in claim 11, wherein positioning comprises positioning a selectively actuatable valve within the coiled tubing.

15. The method as recited in claim 14, wherein coupling comprises coupling the hydraulic assist device to a lead end of the coiled tubing.

16. The method as recited in claim 14, further comprising using the valve within the coiled tubing to control flow along an interior of the coiled tubing.

17. The method as recited in claim 11, wherein coupling comprises coupling a plurality of hydraulic assist devices along the coiled tubing.

18. The method as recited in claim 11, wherein causing comprises expanding at least one flexible sealing ring.

19. The method as recited in claim 11, further comprising positioning an actuator in the hydraulic assist device for causing the hydraulic assist device to expand or contract.

20. The method as recited in claim 19, further comprising actuating the actuator to move the valve between an active mode and a passive mode for controlling fluid flow in the coiled tubing.

* * * * *